United States Patent [19]

Anderson

[11] 4,095,747

[45] Jun. 20, 1978

[54] HIGH PRESSURE COAXIAL FLOW NOZZLES

[75] Inventor: Arthur A. Anderson, St. Paul, Minn.

[73] Assignee: Specialty Manufacturing Company, St. Paul, Minn.

[21] Appl. No.: 773,425

[22] Filed: Feb. 28, 1977

Related U.S. Application Data

[63] Continuation of Ser. No. 686,713, May 17, 1976, abandoned.

[51] Int. Cl.[2] ..... B05B 1/16

[52] U.S. Cl. ..... 239/288.5; 239/441; 239/443

[58] Field of Search ..... 239/437–441, 239/447, 448, 457, 472, 288.5, 443

[56] References Cited

U.S. PATENT DOCUMENTS

| | | | |
|---|---|---|---|
| 555,573 | 3/1896 | Haas | 239/441 |
| 582,051 | 5/1897 | Fuerbringer | 239/441 |
| 1,893,298 | 1/1933 | Moore | 239/441 |
| 2,049,509 | 8/1936 | McDonald | 239/448 |
| 2,252,698 | 8/1941 | Button et al. | 239/441 |

*Primary Examiner*—John J. Love

*Attorney, Agent, or Firm*—Jacobson and Johnson

[57] ABSTRACT

A high pressure spray nozzle is provided having a central stream of fluid that can be changed to a coaxial flow of fluid by rotation of the housing cap to thereby produce an outer stream of fluid which is a coaxial to the central stream of fluid.

6 Claims, 8 Drawing Figures

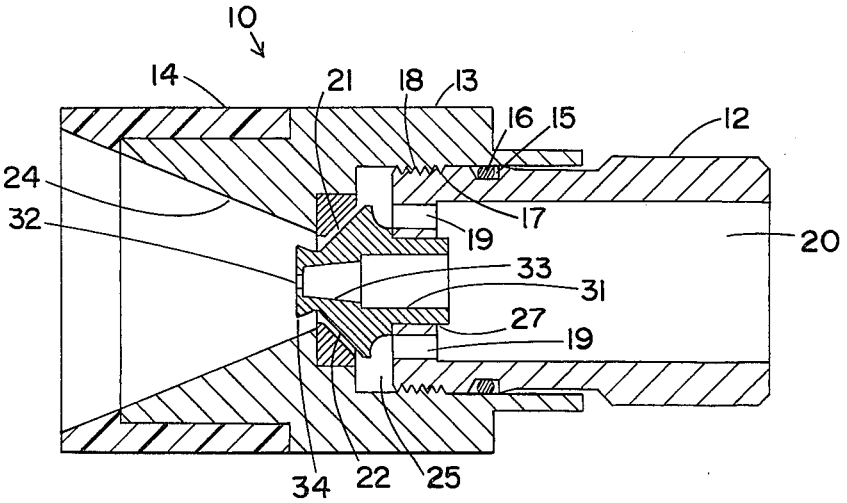
FIG. 1
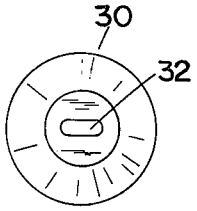
FIG. 2
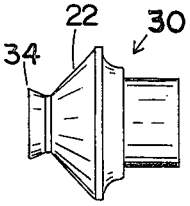
FIG. 3
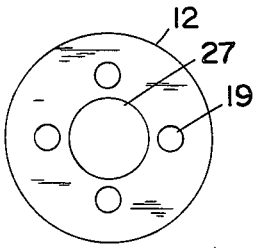
FIG. 4
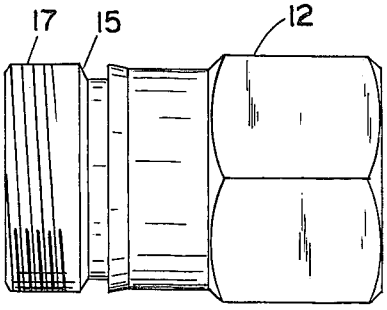
FIG. 5
FIG. 6
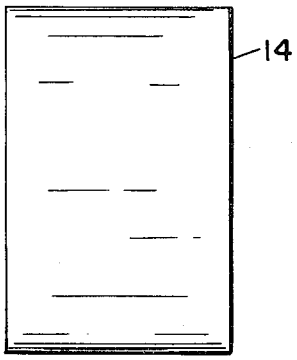
FIG. 7
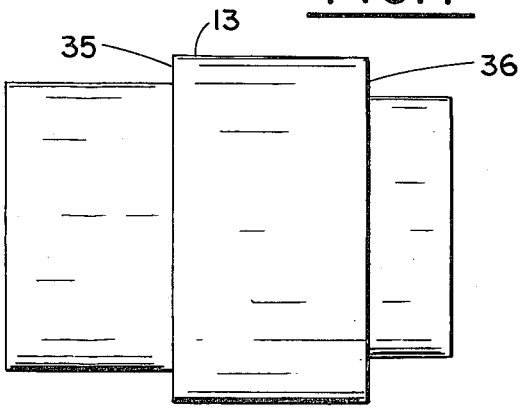

HIGH PRESSURE COAXIAL FLOW NOZZLES

This is a continuation of application Ser. No. 686,713, filed May 17, 1976 now abandoned.

BACKGROUND OF THE INVENTION

1. Field of the Invention

This invention is generally related to nozzles and more specifically to high pressure nozzles for producing at least two distinct flow patterns.

2. Description of the Prior Art

High pressure nozzles are well knwon in the art and the concept of a high pressure nozzle having a safe and effective indexing means to produce at least two different spray patterns are also known in the art. However, most of these types of prior art devices are very bulky or have features which make them hazardous to use or difficult to adjust when under fluid pressure in excess of 500 psi.

The present invention provides a small, compact nozzle which, by partial rotation of the cap, changes the nozzle flow from a high pressure central jet to a lower pressure coaxial spray. Typically, a constant volume pump is used to supply the fluid to operate these high pressure nozzles.

SUMMARY OF THE INVENTION

Briefly, the present invention comprises an improvement to high/low pressure nozzles in which a high pressure stream of fluid can be converted to a lower pressure coaxial stream of fluid by rotating the cap of the nozzle to thereby produce a secondary stream of fluid which is coaxial with the central stream.

BRIEF DESCRIPTION OF THE DRAWING

FIG. 1 is a cross sectional view of my nozzle;

FIG. 2 is an end view of the nozzle insert located in my nozzle;

FIG. 3 is a side view of FIG. 2;

FIG. 4 is a front view of the secondary fluid supply members;

FIG. 5 is a side view of the rear portion of my nozzle;

FIG. 6 is a side view of the shield;

FIG. 7 is a side view of the body of my nozzle; and

DESCRIPTION OF THE PREFERRED EMBODIMENT

Figure 8:
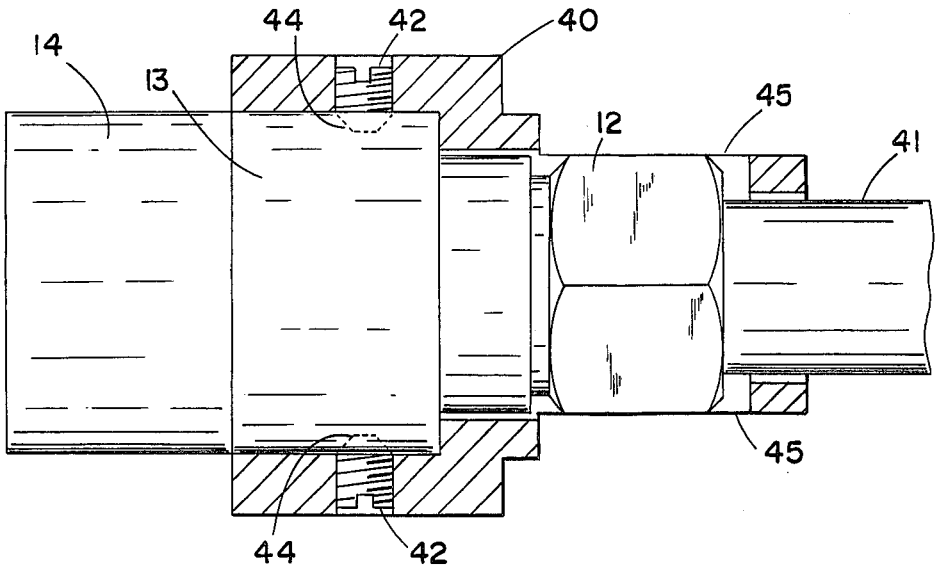
FIG. 8 is a side view of a driver for my nozzle.

Referring to the drawing, FIG. 1 shows a cutaway view of my nozzle which is designated by reference numeral 10. Nozzle 10 comprises a first body member 12 and a second rotatable body member or cap 13 which extends over a portion of body member 12. Body member 12 and body member 13 coact to define an annular fluid chamber 25. Body member 12 is adapted to be connected to a source of high pressure fluid and contains a fluid flow passage 20 for receiving the high pressure fluid and a set of openings 19 which are in fluid communication with an annular chamber 25. Body member 12 contains a central opening 27 having a nozzle insert 30 located therein. Nozzle insert 30 has been made a separate portion from body member 12, but in an alternate embodiment, could be made from the same material as body member 12. Typically, nozzle insert 30 may be press-fit or threaded into body member 12 so that it is securely attached thereto.

Body member 12 is held in contact with body member 13 through a set of male threads 17 which are located in body member 12 and a set of female threads 18 which are located in body member 13. An annular recess 15 located around and in body member 12 contains an O ring 16 for sealing the high pressure fluid within the nozzle and preventing the flow of fluid between the two members.

Nozzle 30 contains an axial or central opening 31, a tapered portion 33 with a fan-type axial opening 32. However, a circular or other shaped opening could also be used. A circular ridge 34 is located on the outer portion of the nozzle and deflects the fluid stream that emanates from annular chamber 25. Located downstream from nozzle insert 30 is a diverging section 24. The diverging section 24 is located within rotatable member 13. Located on the outside of body member 13 and extending partially inside to form a continuous surface with diverging section 24 is a safety shield 14. Typically, safety shield 14 is made from a bright orange, polymer plastic to warn people of the danger of the high pressure fluid.

Circular ridge 34 protects sufficiently so as to deflect the fluid outward from the central flow of fluid but not so great so as to deflect the fluid into the diverging section 24.

Referring to other Figs., the specific details of the nozzle are shown more explicitly. FIG. 4 shows an end view of body member 12 showing the four openings 19 for passage of fluid into chamber 25 as well as a central opening 27 for which nozzle insert 30 is located therein.

In the operation of the nozzle shown, it is desired to have two different streams of fluid to a first central high pressure stream or jet and a second lower pressure coaxial stream of fluid. It should be pointed out that while the two streams are referred to as lower pressure, the pressure of the fluid stream is still within a range that could cause harm to an operator if a portion of the operator's skin should come in contact with the high pressure fluid.

The first high pressure fluid stream is obtained when member 13 is rotated so that the surface 21 (FIG. 1) is in contact with surface 22 (FIGS. 1 and 3). With surfaces 21 and 22 in contact, fluid is trapped in chamber 25 and only a central stream of fluid issues from nozzle insert 30. However, once surface 21 and surface 22 are separated by rotating member 13, with respect to member 12, fluid discharges between surface 21 and surface 22. Therefore, besides the central stream of fluid emanating through nozzle opening 32, there is a second outer or coaxial stream of fluid.

In operation of the nozzle, the fluid flows along surface 22 and deflects off ridge 34. However, as mentioned, the deflection is such that the fluid is not deflected into the diverging walls but is generally deflected at an angle which is less than the angle of deflection of diverging section 24. This is accomplished by having the angle of ridge 34 parallel to the angle of wall 24 or having the angle of the ridge diverge with respect to the angle of diverging wall 24. When the fluid issues from both the annular chamber 25 and the inner nozzle opening 32, one has a coaxial fluid flow at a lower pressure if the upstream openings or restrictions are designed appropriately. That is, the pressure of the stream is reduced if the upstream area or restriction (not shown) is only slightly larger than the combined area of the central opening and the annular opening. With this type of restriction or area relationship, the nozzle can be connected to aspirate a second fluid, such as soap, into the stream.

In the preferred use of my nozzle, the fluid is supplied by a constant volume pump. With a constant volume supply, the smaller the opening in the nozzle, the higher velocity of the stream and, conversely, the larger the nozzle opening, the slower the velocity of the fluid emanating from the nozzle. Accordingly, with all the fluid discharging through nozzle insert 30, one has a high velocity stream of fluid. However, when the area for the same amount of fluid to discharge through is increased, the velocity correspondingly decreases.

Typically, to aspirate a second fluid such as soap, the unit would operate as follows: the high pressure source would be connected to direct fluid through central nozzle 30. A second source of fluid which is not under pressure, would be connected to the line running between the first high pressure source and nozzle 30. The positive pressure associated with high pressure fluid would prevent a second solution from being drawn into the nozzle. However, as the flow velocity increases, the pressure decreases. Under proper conditions, a venturi effect is produced, i.e., a negative pressure or vacuum is produced which will suck the second solution through the nozzle. In this case, the soap will be sucked into the stream to provide a flow of soapy water. The venturi effect and aspirators are well known in the art; therefore, no further description of its operation will be supplied.

Referring to FIG. 8, reference numeral 40 identifies a driver that fastens over and around member 13. Driver 40 comprises an elongated hexagonal section having a pair of set screws 42 located therein. Set screws 42 lock driver 40 to member 13 by setting in an annular groove 44.

The purpose of driver 40 is two-fold, namely, to provide a gripping region so the user can turn body 13 with respect to pipe 41 and member 12 and to also provide a stop to prevent member 13 from accidentally being turned too far; that is, to prevent member 13 from being accidentally removed when the unit is under high pressure.

Referring again to FIG. 8, reference numeral 45 designates a surface on driver 40 which will abutt against end surface 47 if driver 40 is turned too far, thus preventing accidental unscrewing of member 13 from member 12; that is, rotation of driver 40 and member 13 stops when surface 45 contacts non-rotating surface 47.

A further feature of the present invention is that when the invention is used with a constant volume pump, one can produce a continuously variable flow pattern intermediate to the two extreme positions. That is, the nozzle has a proportional control because the area openings are variable. Thus, one can vary the rinse pattern and one can also vary the amount of soap or detergent in the fluid stream by turning nozzle 13 which will correspondingly increase or decrease the pressure to the source of aspirating fluid which, in the preferred embodiment, is soap. For example, as the suction pressure increases, one draws more soap into the stream; conversely, if the suction pressure decreases, one draws less soap into the stream. Therefore, the present invention provides for both a variable supply of soap and also a variable rinse pattern in the same nozzle and with a single control.

I claim:

1. A high pressure nozzle operable for producing spaced fluid streams or a single stream of fluid having sufficient momentum so as to clean an article by the force of the fluid stream issuing from said high pressure nozzle comprising:

a first member for connecting to a constant volume supply of high pressure fluid;

said first member having at least two openings therein including a first fluid passage and a central fluid outlet, said first member operable for permitting continuous discharge of a high momentum fluid stream through said central fluid outlet, said first member reducing the diameter of the fluid stream flowing therethrough without bending the fluid stream emanating from said central fluid outlet;

said first member having a frusto-conical fluid directing surface for directing a fluid stream thereover and a fluid deflector surface for directing a second stream of fluid alongside and spaced from the fluid stream emanating from said central fluid outlet;

a second member connected to said first member, said second member movable with respect to said first member, said second member having a frusto-conical fluid directing surface for directing a fluid stream thereon;

said frusto-conical fluid directing surface on said second member and said frusto-conical fluid directing surface on said first member coacting to define a second fluid passage for directing fluid onto said fluid deflector surface;

said second fluid passage operable for being opened and closed by movement of said second member with respect to said first member to thereby produce spaced fluid streams or a single high momentum fluid stream; and a diverging section located in said second member, said diverging section spaced from said first member and said fluid deflector surface, said diverging section and said fluid deflector surface located at a diverging angle to one another so that fluid from said second fluid passage which is directed onto said fluid detector surface does not impinge on said diverging section, said diverging section extending substantially beyond said central fluid outlet so that said central fluid nozzle is shielded by said second member.

2. The invention of claim 1 wherein said fluid passage comprises an annular opening formed by said first member and said second member.

3. The invention of claim 1 wherein said first member contains a central fluid passage and said first fluid passage includes four radially spaced openings for discharging fluid into said second fluid passage.

4. The invention of claim 3 wherein said second member includes a polymer plastic shroud.

5. The invention of claim 4 wherein said central fluid outlet has an elongated opening therein.

6. The invention of claim 5 wherein a driver is located on said first member to facilitate rotation of said first member with respect to said second member.

* * * * *